United States Patent [19]

Smith

[11] Patent Number: 5,038,451

[45] Date of Patent: Aug. 13, 1991

[54] FOLDING LAWN CHAIR TRAY

[76] Inventor: Clyde D. Smith, 1120 30th, Lubbock, Tex. 79405

[21] Appl. No.: 439,823

[22] Filed: Nov. 21, 1989

[51] Int. Cl.[5] ..... A47B 83/02

[52] U.S. Cl. ..... 29/434; 297/153

[58] Field of Search ..... 297/153, 154, 194, 148–151; 29/429, 434

[56] References Cited

U.S. PATENT DOCUMENTS

| | | | |
|---|---|---|---|
| 710,526 | 10/1902 | Shauck | 297/153 |
| 3,515,429 | 6/1970 | Ballinger | 297/153 |
| 4,003,598 | 1/1977 | Glaze | 297/194 |
| 4,591,206 | 5/1986 | Pribble | 297/153 X |

*Primary Examiner*—Peter R. Brown

*Attorney, Agent, or Firm*—Wendell Coffee

[57] ABSTRACT

A tray attaches to both arms of a folding lawn chair. In the unfolded position the tray is horizontal and the back portion of the tray is toward the back panels of the chair. In the folded position the tray is vertical and the back portion of the tray is toward the front of the arm. In the folded position the tray latches the chair in the folded position and the tray must be removed to unfold the chair. The tray has button knobs on the bottom surface of the back portion which attach into keyhole slots in the top of the arms.

4 Claims, 2 Drawing Sheets

FOLDING LAWN CHAIR TRAY

RIGHTS TO INVENTIONS UNDER FEDERAL RESEARCH

There was no federally sponsored research and development concerning this invention.

BACKGROUND OF THE INVENTION (1) Field of the Invention

This invention relates to chairs and more particularly to folding lawn chairs with trays.

(2) Description of the Related Art

Folding lawn chairs are a popular item of furniture with people having back yards. With people having lawn chairs and back yards, they often also have barbecues or other events wherein food is served, often on paper plates.

Most people have difficulty balancing a plate with food on their knee without a tray, however, often at these back yard social events they are required to do so.

Before this application was filed the applicant was ware of the following U.S. Pat. Nos.:

KAPOSI 3,475,052
GLAZE 4,003,598
PRIBBLE 4,591,206
DAVID 845,222
NOBBE 2,707,020
HOPPERT 2,720,913
BRADEN 2,394,141
REESE 2,968,338
BOLLINGER 3,515,429
STARR 3,788,699

KAPOSI, GLAZE and PRIBBLE were faced with similar a problem but found a different solution for the problem of attaching a tray to a folding chair.

GLAZE specifically in FIG. 6 discloses a track in an arm of a folding lounge chair. With this track and a specific slide upon the bottom of the tray a tray may be attached to one arm of the chair.

DAVID, NOBBE and HOPPERT, were concerned with attaching a tray to a rigid chair.

BRADEN, REESE, BOLLINGER and STARR were concerned with attaching trays to wheel chairs or infant chairs.

SUMMARY OF THE INVENTION (1) Progressive Contribution to the Art

I have made an invention wherein the bottom of a tray is fitted with a button knob, i.e., a knob which extends below the bottom surface of the tray near the back thereof. The arms of the chair have keyhole slots in them. The keyhole slot has a larger portion through which the button knob will fit. The keyhole slot also has a narrow portion so that after the button is in the keyhole, the tray is shoved along the chair arm. Then the button passes into the narrow portion which has a width less than the diameter of the knob so that the back of the tray cannot move upward. The front of the tray can be moved upward to a small degree, however, it is biased downward by gravity. The tray cannot move downward because the tray forward of the knobs rests upon the forward portion of the arms of the chair.

This forms an inexpensive and satisfactory way to attach the tray to the arms. Also it allows a person to have their tray full of food and move it to their chair, be seated in the chair and then without particular difficulty fit the tray, loaded with food, onto the chair for eating purposes.

Also, when the folding chair is folded, the arms are aligned with the back panel of the chair. To store the chair, the tray may be removed, the chair folded and then the tray placed on the arms. In this position, the tray is reversed on the arms so the forward portion of the tray is toward the back of the arms so that it makes a compact unit when the chair is folded. Also in the folded position with the tray attached, the chair is not prone to unfold because the tray acts as a latching device to hold the chair in the folded position.

(2) Objects of this Invention

An object of this invention is to provide a folding chair with a tray.

Further objects are to achieve the above with devices that are sturdy, compact, durable, lightweight, simple, safe, efficient, versatile, ecologically compatible, energy conserving, and reliable, yet inexpensive and easy to manufacture, connect, and maintain.

Other objects are to achieve the above with a method that is rapid, versatile, ecologically compatible, energy conserving, efficient, and inexpensive, and does not require skilled people to connect and maintain.

The specific nature of the invention, as well as other objects, uses, and advantages thereof, will clearly appear from the following description and from the accompanying drawing, the different views of which are not scale drawings.

Figure 1:
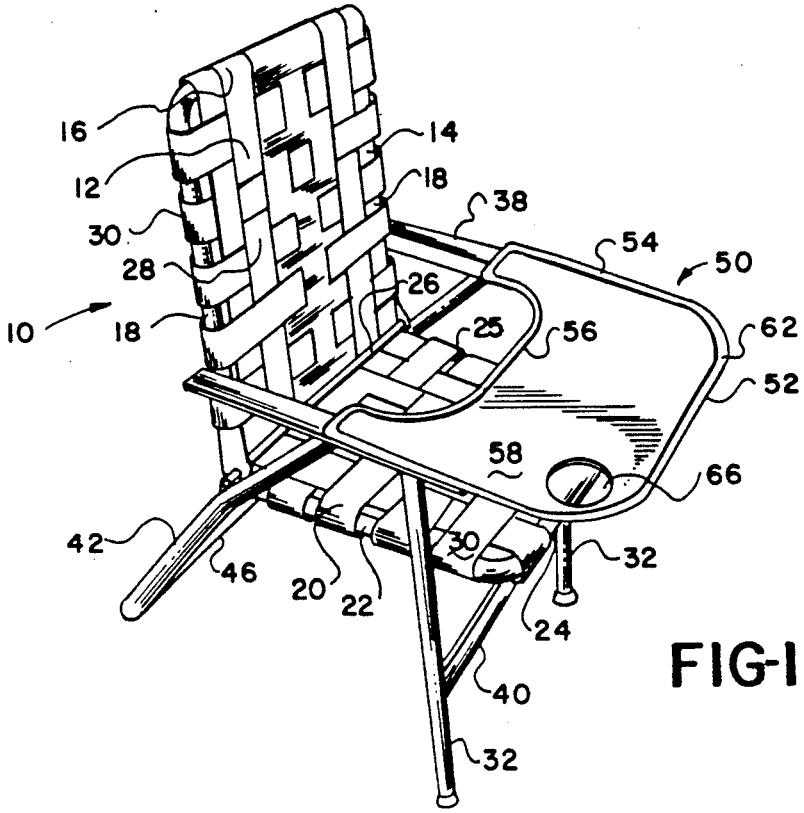
FIG. 1 is a perspective view of a chair in the unfolded position with the tray attached thereto.

As an aid to correlating the terms of the claims to the exemplary drawing, the following catalog of elements and steps is provided:

10 lawn chair
12 back panel
14 metal frame
16 bight
18 vertical members
20 seat panel
22 metal member
24 bight
25 side members
26 pivot rod
28 longitudinal webbing
30 horizontal webbing
32 front legs
34 front legs seat hinge
36 hinged
38 arms
40 brace
42 back legs -continued 44 back leg hinge
46 bight
48 back pivoted
50 tray
52 forward edge
54 side edges
56 back portion
58 top surface
60 bottom surface
62 rounded bead
64 stub portions
66 beverage holder
70 keyhole slot
72 button knob
74 button
76 neck
78 enlarged portion
80 narrow portion

DESCRIPTION OF THE PREFERRED EMBODIMENT

Referring particularly to the drawing, there may be seen lawn chair 10 with tray 50 attached.

Basically the chair is a conventional lawn chair having back panel 12. The back panel 12 includes an inverted U-shaped metal tubing frame 14. The U-shaped frame will have bight 16 at the top with two vertically oriented members 18 on either side. By vertically oriented it is meant that basically they extend up and down but they are not exactly 90 degrees to level.

The seat panel 20 of the chair is also formed of U-shaped tubular metal member 22 which has bight 24 at the forward side of the chair and two side members 25 extending rearward from the front.

The seat panel 20 in the unfolded position is horizontally oriented. The bight 24 is at the front of the seat panel. The back of the seat panel is hinged by rod 26 to the bottom of the back panel 12.

Longitudinal webbing 28 extends from the bight 16 at the top of the back panel 12 underneath the pivot rod 26 and to the bight 24 at the front of the seat panel.

Horizontal webbing 30 extends along the back from one side member 18 to the opposite side member 18 laced into the longitudinal webbing 28. Also the horizontal webbing 30 extends along the seat from one side member 25 to the opposite side member 25 laced into the webbing 28.

There are two front legs 32 one on either side of the chair 10. The front legs are vertically oriented. The front legs have a top and bottom. Each of the front legs is hinged at front legs seat hinge 34 near its top to the seat panel 20 near the front thereof. The front legs are also hinged at 36 at their top to one of two arms 38 near the front of the arms. Near the bottom of the front legs, brace 40 extends from one front leg 32 to the other front leg to hold the two front legs together as a rigid unit.

Back legs 42 have a top and bottom. The top of each back leg is hinged at 44 to one of the arms 38 at about mid-point thereof. Each of the back legs 42 is foldingly connected at pivot rod 26. The folding chairs presently on the market have variations of making the folding connection of the back legs to the pivot rod 26. Some hinge the back legs directly to the pivot rod while others have a connecting link connecting the back legs to the pivot rod. In each case it is accurate to say that the back legs are foldingly connected to the pivot rod.

The back legs are U-shaped, i.e., the back legs 42 are the legs of a U and the bight 46 connects the two legs 42 at the bottom thereof.

Figure 2:
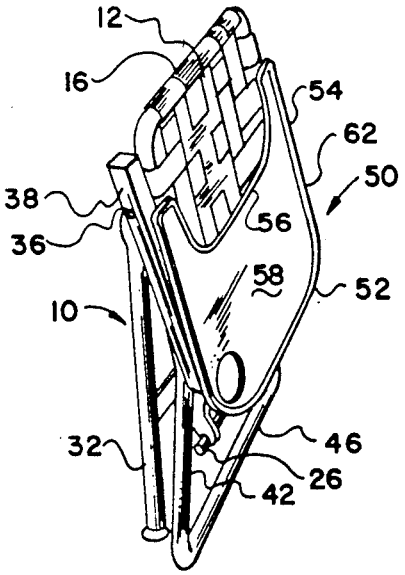
FIG. 2 is a perspective view of a chair in the folded position with the tray attached thereto locking the chair in the folded position.
Figure 3:
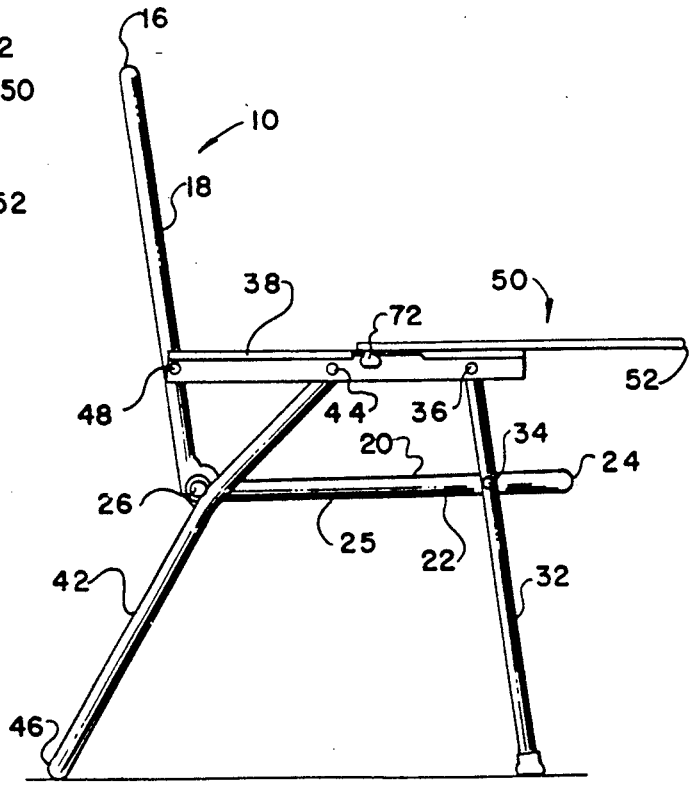
FIG. 3 is a side elevational view of a chair with a tray in the "eating position". Parts have been broken away to show details of instruction.
Figure 4:
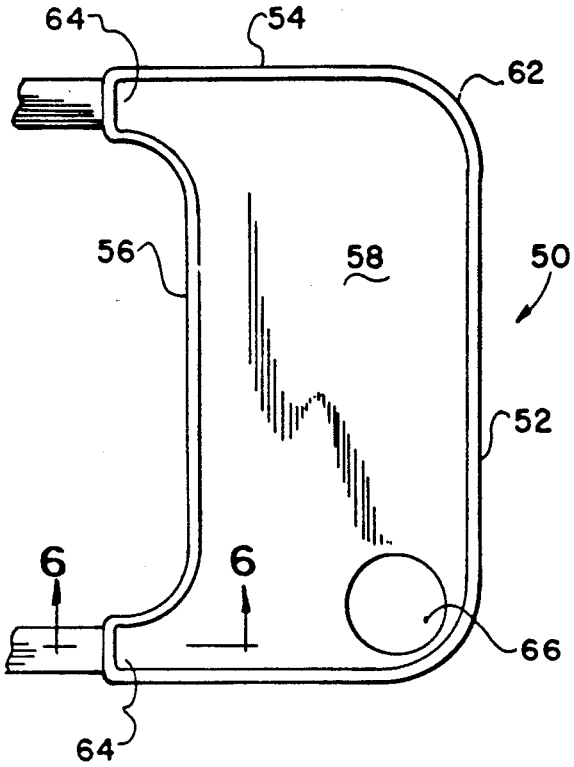
FIG. 4 is a partial top plan view of the tray upon the arms of the chair.
Figure 5:
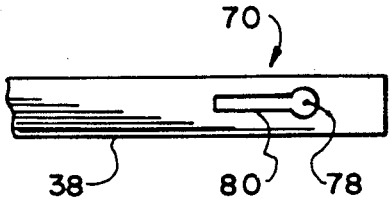
FIG. 5 is a partial top plan view of the arms of the chair particularly showing the keyhole slot.
Figure 6:
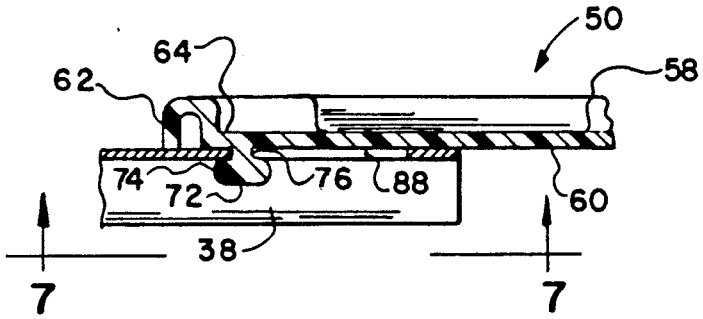
FIG. 6 is a partial sectional view taken substantially along lines 6—6 of FIG. 4, showing construction.
Figure 7:
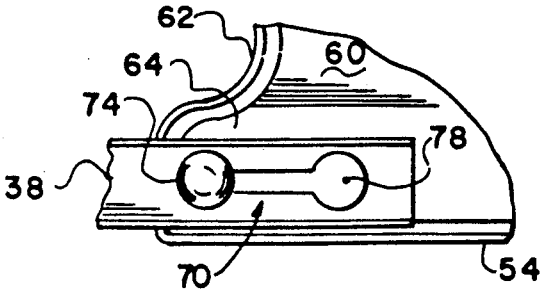
FIG. 7 is a bottom plan view of the arm and tray connection taken substantially along line 7—7 of FIG. 6.

Each of the arms 38 have a front and a back. The back is pivoted at 48 to the vertical members 18 of the back panel 12. The arms are horizontally oriented, basically parallel to the seat panel 20. The arms have a top and bottom. The arms are preferably made of plastic material but may be made of metal. The top of the arms are preferably flat. When the chair is folded as seen in FIG. 2 the arms 38 are aligned with the back panel 12.

Those skilled in the art will understand that the chair as described to this point is well known and has been commercially available on the market for many years.

Tray 50 bears some similarity to the trays of the prior art. I.e., it is made of plastic and is basically rectangular. It has a forward edge 52, two side edges 54 a back portion 56, a top surface 58 and a bottom surface 60. A rounded upstanding bead 62 extends around the entire tray. The beads 62 provide rigidity to the tray. The back portion of the tray has a U-shape configuration so that at the back of the tray there are short stubs 64. Beverage holder 66 is in the form of a circular cutout within the forward portion of the tray.

As stated above the tray to this point is not particularly unique.

Keyhole slot 70 is formed in the forward portion of each of the arms 38. Button knob 72 is formed at the extreme rearward portion of each of the stubs 64 of the bottom surface 60 of tray 50. The button knob has enlarged button 74 on the bottom thereof. This button 74 is connected to the bottom surface 60 of tray 50 by neck 76. The neck is of much smaller diameter than the diameter of the button 74. The keyhole slot 70 has enlarged portion 78. The enlarged portion 78 is larger than the diameter of the button 74 so that the button may fit therethrough. The keyhole slot also includes narrow portion 80. The width of the small or narrow portion 80 is less than the diameter of the button 74 but greater than the diameter of the neck 76. Therefore it may be seen that the tray may be fitted on the arms and the button inserted through the enlarged portion 78 and then the tray moved rearwardly so that the buttons 74 will prohibit the rear portion of the tray from moving upward. The front of the tray is prevented from moving downward because it rests upon the top of the arms 38.

The button knobs, i.e., the button 74 with the neck 76 maybe attached as by a screw through the tray to attach them thereby or they may be molded forming an integral portion with the tray.

Therefore it may be seen that I have provided a simple arrangement for attaching a tray to a folding chair when the chair is in the unfolded or eating position with the tray in place. Also it will be understood that a person can carry the tray with food much the same as a person might carry a cafeteria tray to his chair and then while holding the tray, be seated in his chair and then fit the tray onto the arms of the chair so that he can comfortably eat therefrom.

When the chairs 10 are to be stored the tray is removed by sliding the tray portion forward and disengaging the tray by moving the buttons 74 upward through the enlarged portions 78. Then the chair may be folded so that the arms are aligned with the back. Then the tray 50 may be conveniently attached to the arms. In this instance the tray will be reversed from its previous condition so that the front 52 of the tray is away from the front of the arms which is to say the front of the tray 52 is toward the back of the arms which is proximate the pivot rod 26. Therefore the folded chair with the tray form a very compact unit easily stored. One of the advantages of the tray fitting to the arms in the storage position is that the tray locks the chair so it cannot be unfolded with the tray in place. People storing folding lawn chairs often experience a certain amount of frustration because the chairs seem to unfold when it is undesirable for them to do so. However, with the trays in place, the tray functions as a locking device to prevent the unfolding of the chair.

The embodiment shown and described above is only exemplary. I do not claim to have invented all the parts, elements or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. A method of attaching a tray to a folding arm chair, said arm chair having:

a. a back panel, b. a pair of arms each having a top, bottom, front and back, one on each side of the chair, so arranged and constructed that when the chair is in the unfolded position the arms are in a horizontal orientation extending away from the back and when the chair is in a folded position the arms are aligned with the back panel, said tray having:

c. a forward edge, two side edges, a back portion, top surface, and a bottom surface, d. attachment means on the bottom surface near each side edge of the back portion thereof; wherein the improved method of attaching the tray to the chair in an eating position and a storing position comprises:

e. attaching the tray in the eating position to the unfolded chair at the top of the arms near the front thereof with the front of the tray extending forward of the arms, f. detaching the tray, then g. folding the chair, and then h. attaching the tray in the storing position at the top of the arms behind the back panel of the chair with the front of the tray toward the back of the arms, thus i. locking the chair to prevent the unfolding of the chair.

2. The invention as defined in claim 1 further comprising said attaching step comprising:

j. inserting button knobs on the bottom side of the tray on each side near the back thereof into a keyhole slot cut into the top of the arms, k. said keyhole slot having a narrow slot portion behind an enlarged insertion portion thereof.

3. A method of attaching a tray to a folding arm chair, said arm chair having:

a. a horizontal oriented seat panel having a front and back, b. a vertical oriented back panel having a top and bottom hinged at the bottom to the back of the seat panel, c. a pair of arms each having a top, bottom, front, and back, one on each side of the chair, each of the arms hinged at the back of the arm to the back panel near the bottom thereof, d. a pair of front legs having a top and bottom one on each side of the chair, i. each front leg hinged at its top to the front of an arm, ii. each front leg hinged near its top to the seat near the front of the seat, and e. a pair of back legs having a top and a bottom, one on each side of the chair, each back leg hinged at its top to an arm between the front and back;

f. so that when the arm chair is folded the arms are aligned with the back panel, said tray having:

g. a forward edge, two side edges, a back portion, top surface, and a bottom surface, h. attachment means on the bottom surface near each side edge near the back portion thereof;

wherein the improved method of attaching the tray to the chair in an eating position and a storing position comprises the following steps:

j. attaching the tray in the eating position to the unfolded chair at the top of the arms near the front thereof with the front of the tray extending forward of the arms, k. detaching the tray, then l. folding the chair, and then m. attaching the tray in the storing position at the top of the arms behind the back panel of the chair with the front of the tray toward the back of the arms, thereby mm. locking the chair to prevent the unfolding of the chair.

4. The invention as defined in claim 3 further comprising said attaching step comprising:

n. inserting button knobs on the bottom side of the tray on each side near the back thereof into a keyhole slot cut into the top of the arms, o. said keyhole slot having a narrow slot portion behind an enlarged insertion portion thereof.

* * * * *